US007700880B2

(12) United States Patent
Varkey et al.

(10) Patent No.: US 7,700,880 B2
(45) Date of Patent: Apr. 20, 2010

(54) ENHANCED ELECTRICAL CABLES

(75) Inventors: Joseph Varkey, Missouri City, TX (US); Garud Sridhar, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/176,596

(22) Filed: Jul. 21, 2008

(65) Prior Publication Data

US 2008/0289849 A1 Nov. 27, 2008

Related U.S. Application Data

(63) Continuation of application No. 11/561,646, filed on Nov. 20, 2006, now Pat. No. 7,402,753, which is a continuation-in-part of application No. 11/033,698, filed on Jan. 12, 2005, now Pat. No. 7,170,007.

(51) Int. Cl.
*H01B 7/18* (2006.01)

(52) U.S. Cl. ..... 174/102 R; 174/106 R

(58) Field of Classification Search ..... 174/102 R, 174/106 R

See application file for complete search history.

(56) References Cited

U.S. PATENT DOCUMENTS

| | | | |
|---|---|---|---|
| 1,948,439 | A | 2/1934 | Budscheid |
| 2,604,509 | A | 7/1952 | Blanchard |
| 3,115,542 | A | 12/1963 | Palandri |
| 3,217,083 | A | 11/1965 | Gore |
| 4,131,757 | A | 12/1978 | Felkel |
| 4,131,758 | A | 12/1978 | Felkel |
| 4,523,804 | A | 6/1985 | Thompson |
| 4,645,298 | A | 2/1987 | Gartside, III |
| 4,675,474 | A | 6/1987 | Neuroth |
| 4,979,795 | A | 12/1990 | Mascarenhas |
| 5,329,605 | A | 7/1994 | Wargotz |
| 5,431,759 | A | 7/1995 | Neuroth |

(Continued)

FOREIGN PATENT DOCUMENTS

| | | |
|---|---|---|
| EP | 0471600 | 2/1992 |

(Continued)

OTHER PUBLICATIONS

SM Lebedev, OS Gefle, Yu P Pokholkov and VI Chichikin, "The Breakdown Strength of Two-Layer Dielectrics", High Voltage Engineering Symposium, Aug. 22-27, 1999, Tomsk Polytechnic University, Tomsk, Russia #4.304.P2.

(Continued)

*Primary Examiner*—Chau N Nguyen
(74) *Attorney, Agent, or Firm*—Michael L. Flynn; David Hofman; Jody Lynn Destefaris

(57) ABSTRACT

Electrical cables formed from at least one insulated conductor, a layer of inner armor wires disposed adjacent the insulated conductor, and a layer of shaped strength members disposed adjacent the outer periphery of the first layer of armor wires. A polymeric material is disposed in interstitial spaces formed between the inner armor wires and the layer of shaped strength members, and the polymeric material is further disposed in interstitial spaces formed between the inner armor wire layer and insulated conductor. The polymeric material serves as a continuously bonded layer which also separates and encapsulates the armor wires forming the inner armor wire layer.

17 Claims, 10 Drawing Sheets

U.S. PATENT DOCUMENTS

| | | | | |
|---|---|---|---|---|
| 5,495,547 | A | 2/1996 | Rafie | |
| 6,030,255 | A | 2/2000 | Konishi | |
| 6,060,662 | A | 5/2000 | Rafie | |
| 6,195,487 | B1 | 2/2001 | Anderson | |
| 6,211,467 | B1 | 4/2001 | Berelsman | |
| 6,403,889 | B1 | 6/2002 | Mehan | |
| 6,555,752 | B2 | 4/2003 | Dalrymple | |
| 6,600,108 | B1 | 7/2003 | Mydur | |
| 6,747,213 | B2 | 6/2004 | Bonicel | |
| 7,170,007 | B2 * | 1/2007 | Varkey et al. | 174/102 R |
| 7,402,753 | B2 * | 7/2008 | Varkey et al. | 174/102 R |
| 2004/0262027 | A1 | 12/2004 | Kaczmarski | |

FOREIGN PATENT DOCUMENTS

| | | |
|---|---|---|
| JP | 54007186 | 1/1979 |
| JP | 02216710 | 8/1990 |
| WO | 9948111 | 9/1999 |

OTHER PUBLICATIONS

MMA Salama, R Hackman, Fellow and AY Chikhani, Sr., "Instructional Design of Multi-Layer Insulation of Power Cables", Transaction of Power Systems, vol. 7, No. 1, Feb. 1992, pp. 377-382.

* cited by examiner

ENHANCED ELECTRICAL CABLES

RELATED APPLICATION DATE

This application is a continuation of patent application Ser. No. 11/561,646, now U.S. Pat. No. 7,402,853, filed Nov. 20, 2006, which is a continuation-in-part application of U.S. patent application Ser. No. 11/033,698, now U.S. Pat. No. 7,170,007, filed Jan. 12, 2005, and claims the benefit of the filing dates thereof, the disclosures of each of which are hereby incorporated by reference in their entirety.

BACKGROUND OF THE INVENTION

1. Field of the Invention

This invention relates to wellbore electric cables, and methods of manufacturing and using such cables. In one aspect, the invention relates to a durable and sealed torque balanced enhanced electric cable used with wellbore devices to analyze geologic formations adjacent a wellbore, methods of manufacturing same, as well as uses of such cables.

2. Description of the Related Art

Generally, geologic formations within the earth that contain oil and/or petroleum gas have properties that may be linked with the ability of the formations to contain such products. For example, formations that contain oil or petroleum gas have higher electrical resistivity than those that contain water. Formations generally comprising sandstone or limestone may contain oil or petroleum gas. Formations generally comprising shale, which may also encapsulate oil-bearing formations, may have porosities much greater than that of sandstone or limestone, but, because the grain size of shale is very small, it may be very difficult to remove the oil or gas trapped therein. Accordingly, it may be desirable to measure various characteristics of the geologic formations adjacent to a well before completion to help in determining the location of an oil- and/or petroleum gas-bearing formation as well as the amount of oil and/or petroleum gas trapped within the formation.

Logging tools, which are generally long, pipe-shaped devices, may be lowered into the well to measure such characteristics at different depths along the well. These logging tools may include gamma-ray emitters/receivers, caliper devices, resistivity-measuring devices, neutron emitters/receivers, and the like, which are used to sense characteristics of the formations adjacent the well. A wireline cable connects the logging tool with one or more electrical power sources and data analysis equipment at the earth's surface, as well as providing structural support to the logging tools as they are lowered and raised through the well. Generally, the wireline cable is spooled out of a truck, over a pulley, and down into the well.

Wireline cables are typically formed from a combination of metallic conductors, insulative material, filler materials, jackets, and metallic armor wires. Commonly, the useful life of a wellbore electric cable is typically limited to only about 6 to 24 months, as the cable may be compromised by exposure to extremely corrosive elements, or little or no maintenance of cable strength members, such as armor wires. A primary factor limiting wireline cable life is armor wire failure, where fluids present in the downhole wellbore environment lead to corrosion and failure of the armor wires.

Armor wires are typically constructed of cold-drawn pearlitic steel coated with zinc for corrosion protection. While zinc protects the steel at moderate temperatures, it is known that corrosion is readily possible at elevated temperatures and certain environmental conditions. Although the cable core may still be functional, it is generally not economically feasible to replace the armor wire, and the entire cable must be discarded. Once corrosive fluids infiltrate into the annular gaps, it is difficult or impossible to completely remove them. Even after the cable is cleaned, the corrosive fluids remain in interstitial spaces damaging the cable. As a result, cable corrosion is essentially a continuous process which may begin with the wireline cable's first trip into the well. Once the armor wire begins to corrode, strength is quickly lost, and the entire cable must be replaced. Armor wires in wellbore electric cables are also associated with several operational problems including torque imbalance between armor wire layers, difficult-to-seal uneven outer profiles, and loose or broken armor wires.

In wells with surface pressures, the electric cable is run through one or several lengths of piping packed with grease, also known as flow tubes, to seal the gas pressure in the well while allowing the wireline to travel in and out of the well. Because the armor wire layers have unfilled annular gaps or interstitial spaces, dangerous gases from the well can migrate into and travel through these gaps upward toward lower pressure. This gas tends to be held in place as the wireline travels through the grease-packed piping. As the wireline goes over the upper sheave at the top of the piping, the armor wires may spread apart, or separate, slightly and the pressurized gas is released, where it becomes a fire or explosion hazard. Further, while the cables with two layers of armor wires are under tension, the inner and outer armor wires, generally cabled at opposite lay angles, rotate slightly in opposite directions, causing torque imbalance problems. To create a torque-balanced cable, inner armor wires would have to be somewhat larger than outer armor wires, but the smaller outer wires would quickly fail due to abrasion and exposure to corrosive fluids. Therefore, larger armor wires are placed at the outside of the wireline cable, which results in torque imbalance.

Armored wellbore cables may also wear due to point-to-point contact between armor wires. Point-to-point contact wear may occur between the inner and outer armor wire layers, or oven side-to-side contact between armor wires in the same layer. While under tension and when cables go over sheaves, radial loading causes point loading between outer and inner armor wires. Point loading between armor wire layers removes the zinc coating and cuts groves in the inner and outer armor wires at the contact points. This causes strength reduction, leads to premature corrosion and may accelerate cable fatigue failure. Also, due to annular gaps or interstitial spaces between the inner armor wires and the cable core, as the wireline cable is under tension the cable core materials tend to creep thus reducing cable diameter and causing linear stretching of the cable as well as premature electrical shorts.

It is commonplace that as wellbore electrical cables are lowered into an unobstructed well, the tool string rotates to relieve torque in the cable. When the tool string becomes stuck in the well (for example, at an obstruction, or at a bend in a deviated well) the cable tension is typically cycled until the cable can continue up or down the hole. This bouncing motion creates rapidly changing tension and torque, which can cause several problems. The sudden changes in tension can cause tension differentials along the cables length, causing the armor wires to "birdcage." Slack cable can also loop around itself and form a knot in the wireline cable. Also, for wellbore cables, it is a common solution to protect armor wire by "caging." In caging designs, a polymer jacket is applied over the outer armor wire. A jacket applied directly over a standard outer layer of armor wires, which is essentially a sleeve. This type of design has several problems, such as, when the jacket is damaged, harmful well fluids enter and are trapped between the jacket and the armor wire, causing corrosion, and since damage occurs beneath the jacket, it may go unnoticed until a catastrophic failure.

Also, during wellbore operations, such as logging, in deviated wells, wellbore cables make significant contact with the wellbore surface. The spiraled ridges formed by the cables' armor wire commonly erode a groove in the side of the wellbore, and as pressure inside the well tends to be higher than pressure outside the well, the cable is prone to stick into the formed groove. Further, the action of the cable contacting and moving against the wellbore wall may remove the protective zinc coating from the armor wires, causing corrosion at an increased rate, thereby reducing the cable life.

Thus, a need exists for wellbore electric cables that prevent wellbore gas migration and escape, are torque-resistant with a durable jacket that resist stripping, bulging, cut-through, corrosion, abrasion, avoids the problems of birdcaging, armor wire milking due to high armor, looping and knotting, and are stretch-resistant, crush-resistant as well as being resistant to material creep and differential sticking. An electrical cable that can overcome one or more of the problems detailed above while conducting larger amounts of power with significant data signal transmission capability would be highly desirable, and the need is met at least in part by the following invention.

BRIEF SUMMARY OF THE INVENTION

In one aspect of the invention, a wellbore electrical cable is provided. The cable includes at least one insulated conductor, at least one layer of armor wires surrounding the insulated conductor, and a polymeric material disposed in the interstitial spaces formed between armor wires and interstitial spaces formed between the armor wire layer and insulated conductor. The insulated conductor is formed from a plurality of metallic conductors encased in an insulated jacket. Further, a layer of shaped strength members disposed adjacent the outer periphery of the first layer of armor wires, where the strength members forming a substantially smooth outer surface of the cable. The polymeric material also disposed in interstitial spaces formed between the inner armor wires and layer of shaped strength members, and interstitial spaces formed between the inner armor wire layer and insulated conductor. The polymeric material forms a continuously bonded layer which separates and encapsulates the armor wires forming the inner armor wire layer wire layer. The polymeric material may be formed from polyolefins, polyaryletherether ketone, polyaryl ether ketone, polyphenylene sulfide, polymers of ethylene-tetrafluoroethylene, polymers of poly(1,4-phenylene), polytetrafluoroethylene, perfluoroalkoxy polymers, fluorinated ethylene propylene, perfluoromethoxy polymers, and any mixtures thereof, and may further include wear resistance particles or even short fibers.

In another aspect of the invention, disclosed are cables which have at least one insulated conductor, at least one layer of composite strength members surrounding the insulated conductor with a filler disposed in the interstices formed between the composite strength members, and a polymeric material disposed in interstitial spaces formed between the armor wires and interstitial spaces formed between the armor wires and the insulated conductor. The polymeric material forms a continuously bonded layer which separates and encapsulates inner armor wires. The, a layer of shaped strength members is disposed adjacent the outer periphery of the first layer of armor wires, where the strength members forming a substantially smooth outer surface of the cable.

In yet another aspect of the invention, disclosed are electrical cables formed from at least one insulated conductor, a layer of inner armor wires disposed adjacent the insulated conductor, and a layer of shaped strength members disposed adjacent the outer periphery of the first layer of armor wires. A polymeric material is disposed in interstitial spaces formed between the inner armor wires and the layer of shaped strength members, and the polymeric material is further disposed in interstitial spaces formed between the inner armor wire layer and insulated conductor. The polymeric material serves as a continuously bonded layer which also separates and encapsulates the armor wires forming the inner armor wire layer wire layer.

Some other cables according to the invention include insulated conductors which are coaxial cable, quadcable, or even heptacable designs. In coaxial cables of the invention, a plurality of metallic conductors surround the insulated conductor, and are positioned about the same axis as the insulated conductor.

Further disclosed herein are methods of using the cables of the invention in seismic and wellbore operations, including logging operations. The methods generally comprise attaching the cable with a wellbore tool and deploying such into a wellbore. The wellbore may or may not be sealed. In such methods, the cables of the invention may minimize or even eliminate the need for grease packed flow tubes and related equipment, as well as minimizing cable friction, wear on wellbore hardware and wellbore tubulars, and differential sticking. Also, the cables according to the invention may be spliced cables as used in wellbore operations wherein the wellbore is sealed.

BRIEF DESCRIPTION OF THE DRAWINGS

The invention may be understood by reference to the following description taken in conjunction with the accompanying drawings.

DETAILED DESCRIPTION OF THE INVENTION

Figure 1:
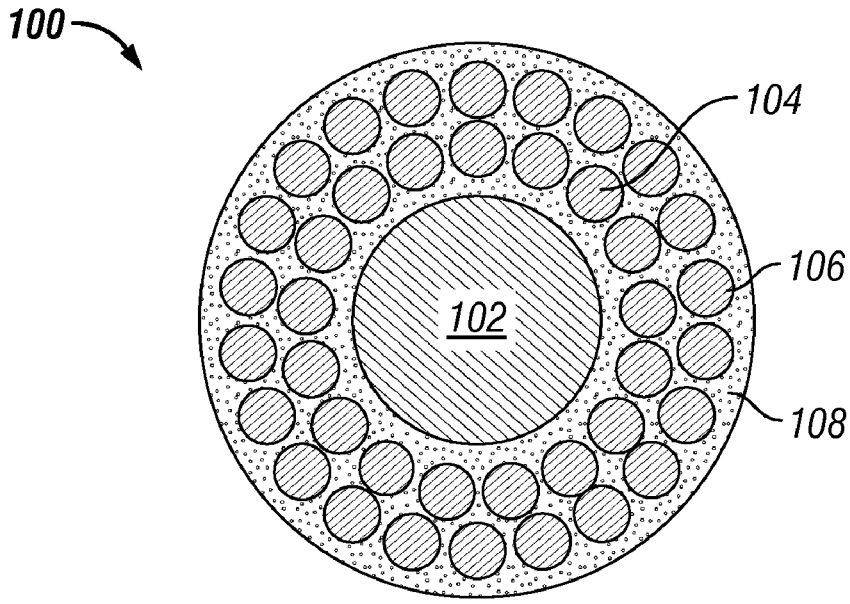
FIG. 1 is stylized a cross-sectional generic representation of cables according to the invention.

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure.

The invention relates to wellbore cables and methods of manufacturing the same, as well as uses thereof. In one aspect, the invention relates to an enhanced electrical cables used with devices to analyze geologic formations adjacent a wellbore, methods of manufacturing the same, and uses of the cables in seismic and wellbore operations. Cables according to the invention described herein are enhanced and provide such benefits as wellbore gas migration and escape prevention, as well as torque-resistant cables with durable jackets that resist stripping, bulging, cut-through, corrosion, and abrasion. It has been discovered that protecting armor wires with durable jacket materials that contiguously extend from the cable core to a smooth outer jacket provides an excellent sealing surface which is torque balanced and significantly reduces drag. Operationally, cables according to the invention eliminate the problems of fires or explosions due to wellbore gas migration and escape through the armor wiring, birdcaging, stranded armors, armor wire milking due to high armor, and looping and knotting. Cable according to the invention are also stretch-resistant, crush-resistant as well as resistant to material creep and differential sticking.

Cables of the invention generally include at least one insulated conductor, least one layer of armor wires, or other suitable strength member, surrounding the insulated conductor, and a polymeric material disposed in the interstitial spaces formed between armor wires and the interstitial spaces formed between the armor wire layer and insulated conductor. Insulated conductors useful in the embodiments of the invention include metallic conductors encased in an insulated jacket. Any suitable metallic conductors may be used. Examples of metallic conductors include, but are not necessarily limited to, copper, nickel coated copper, or aluminum. Preferred metallic conductors are copper conductors. While any suitable number of metallic conductors may be used in forming the insulated conductor, preferably from 1 to about 60 metallic conductors are used, more preferably 7, 19, or 37 metallic conductors. Insulated jackets may be prepared from any suitable materials known in the art. Examples of suitable insulated jacket materials include, but are not necessarily limited to, polytetrafluoroethylene-perfluoromethylvinylether polymer (MFA), perfluoro-alkoxyalkane polymer (PFA), polytetrafluoroethylene polymer (PTFE), ethylene-tetrafluoroethylene polymer (ETFE), ethylene-propylene copolymer (EPC), poly(4-methyl-1-pentene) (TPX® available from Mitsui Chemicals, Inc.), other polyolefins, other fluoropolymers, polyaryletherether ketone polymer (PEEK), polyphenylene sulfide polymer (PPS), modified polyphenylene sulfide polymer, polyether ketone polymer (PEK), maleic anhydride modified polymers, Parmax® SRP polymers (self-reinforcing polymers manufactured by Mississippi Polymer Technologies, Inc based on a substituted poly (1,4-phenylene) structure where each phenylene ring has a substituent R group derived from a wide variety of organic groups), or the like, and any mixtures thereof.

In some embodiments of the invention, the insulated conductors are stacked dielectric insulated conductors, with electric field suppressing characteristics, such as those used in the cables described in U.S. Pat. No. 6,600,108 (Mydur, et al.), hereinafter incorporated by reference. Such stacked dielectric insulated conductors generally include a first insulating jacket layer disposed around the metallic conductors wherein the first insulating jacket layer has a first relative permittivity, and, a second insulating jacket layer disposed around the first insulating jacket layer and having a second relative permittivity that is less than the first relative permittivity. The first relative permittivity is within a range of about 2.5 to about 10.0, and the second relative permittivity is within a range of about 1.8 to about 5.0.

Cables according to the invention include at least one layer of armor wires surrounding the insulated conductor. The armor wires may be generally made of any suitable material or materials, including high tensile strength material including, but not necessarily limited to, galvanized improved plow steel, alloy steel, or the like, or even of a bimetallic arrangement. In some embodiments of the invention, cables comprise an inner armor wire layer surrounding the insulated conductor and an outer armor wire layer served around the inner armor wire layer. A protective polymeric coating may be applied to each strand of armor wire for corrosion protection or even to promote bonding between the armor wire and the polymeric material disposed in the interstitial spaces. As used herein, the term bonding is meant to include chemical bonding, mechanical bonding, or any combination thereof. Examples of coating materials which may be used include, but are not necessarily limited to, fluoropolymers, fluorinated ethylene propylene (FEP) polymers, ethylene-tetrafluoroethylene polymers (Tefzel™), perfluoro-alkoxyalkane polymer (PFA), polytetrafluoroethylene polymer (PTFE), polytetrafluoroethylene-perfluoromethylvinylether polymer (MFA), polyaryletherether ketone polymer (PEEK), or polyether ketone polymer (PEK) with fluoropolymer combination, polyphenylene sulfide polymer (PPS), PPS and PTFE combination, latex or rubber coatings, and the like. Each armor wire may also be plated with materials for corrosion protection or even to promote bonding between the armor wire and polymeric material. Nonlimiting examples of suitable plating materials include brass, copper alloys, and the like. Plated armor wires may even cords such as tire cords. While any effective thickness of plating or coating material may be used, a thickness from about 10 microns to about 100 microns is preferred.

Cables according to the invention include an outer armoring layer disposed adjacent the inner layer of armor wires, where the outer armoring layer includes strength members which are secured in place around the cable's circumference and form a substantially smooth outer cable surface. These embodiments offer at least some of the following advantages: the smooth outer surface provides an enhanced sealing surface; securing the strength members together distributes impact forces around the circumference of the wireline, thereby increasing resistance to compression or impact forces as well as reducing the incidence of bird-caging; by decreasing the amount of space between the outer strength members, wireline strength can be increased; torque balanced cable designs are possible; increasing the surface contact area between strength members may substantially reduce torque imbalance caused by alloy-wire slickness.

As described above, an outer armoring layer may be disposed adjacent the inner layer of armor wires. By "adjacent" it is meant that the layers are in close proximity, but may or may not be in physical contact, but does mean the absence of the same kind in between. The term "substantially smooth", as used above to describe the outer surface of a cable formed of strength members, means the outer circumferential surface is essentially smooth but may have interruptions or slight variations in shape primarily due to use of a plurality of strength members. Examples of such include, but are not necessarily limited to, gaps formed between individual strength members, the outer surfaces of neighboring members orientated in different planes, and the like. Also, a polymeric material may at least be partially disposed in interstitial spaces formed between shaped strength members. When shaped strength members are used to form the outer cable layer, the members may have any cross-sectional geometric shape which serves to maintain the position of the shaped strength members within the layer of strength members. Examples of such shapes include, but are not limited to, trapezoidal, rhombic, triangular, square, keystone, oval, circular, concave, convex, rectangular, shield shapes, or any practical combination thereof. The shaped strength members may be generally made of any suitable material or materials, including high tensile strength material including, but not necessarily limited to, galvanized improved plow steel, alloy steel, or the like, or even of a bimetallic composite.

Armor wires or shaped strength members useful for cable embodiments of the invention, may have bright, drawn high strength steel wires (of appropriate carbon content and strength for wireline use) placed at the core of the armor wires, and an alloy with resistance to corrosion is then clad over the core, which form a bimetallic wire or member. Such a bimetallic wire is shown at 1404*a* in FIG. 14A and comprises a preferably high strength steel core 1404*b* having an alloy 1404*c* clad over the core 1404*b*. Such a bimetallic strength member is shown at 1406*a* in FIG. 14B and comprises a preferably high strength steel core 1406*b* having an alloy 1406*c* clad over the core 1404*b*. The corrosion resistant alloy layer may be clad over the high strength core by extrusion or by forming over the steel wire. The corrosion resistant clad may be from about 50 microns to about 600 microns in thickness. The material used for the corrosion resistant clad may be any suitable alloy that provides sufficient corrosion resistance and abrasion resistance when used as a clad. The alloys used to form the clad may also have tribological properties adequate to improve the abrasion resistance and lubricating of interacting surfaces in relative motion, or improved corrosion resistant properties that minimize gradual wearing by chemical action, or even both properties.

While any suitable alloy may be used as a corrosion resistant alloy clad to form armor wires or shaped strength members, some examples include, but are not necessarily limited to: beryllium-copper based alloys; nickel-chromium based alloys (such as Inconel® available from Reade Advanced Materials, Providence, R.I. USA 02915-0039); superaustenitic stainless steel alloys (such as 20Mo6® of Carpenter Technology Corp., Wyomissing, Pa. 19610-1339 U.S.A., INCOLOY® alloy 27-7MO and INCOLOY® alloy 25-6MO from Special Metals Corporation of New Hartford, N.Y., U.S.A., or Sandvik 13RM19 from Sandvik Materials Technology of Clarks Summit, Pa. 18411, U.S.A.); nickel-cobalt based alloys (such as MP35N from Alloy Wire International, Warwick, R.I., 02886 U.S.A.); copper-nickel-tin based alloys (such as ToughMet® available from Brush Wellman, Fairfield, N.J., USA); or, nickel-molybdenum-chromium based alloys (such as HASTELLOY® C276 from Alloy Wire International). The corrosion resistant alloy clad may also be an alloy comprising nickel in an amount from about 10% to about 60% by weight of total alloy weight, chromium in an amount from about 15% to about 30% by weight of total alloy weight, molybdenum in an amount from about 2% to about 20% by weight of total alloy weight, cobalt in an amount up to about 50% by weight of total alloy weight, as well as relatively minor amounts of other elements such as carbon, nitrogen, titanium, vanadium, or even iron. The preferred alloys are nickel-chromium based alloys, and nickel-cobalt based alloys.

Polymeric materials are disposed in the interstitial spaces formed between armor wires, and interstitial spaces formed between the armor wire layer and insulated conductor. While the current invention is not particularly bound by any specific functioning theories, it is believed that disposing a polymeric material throughout the armor wires interstitial spaces, or unfilled annular gaps, among other advantages, prevents dangerous well gases from migrating into and traveling through these spaces or gaps upward toward regions of lower pressure, where it becomes a fire, or even explosion hazard. In cables according to the invention, the armor wires are partially or completely sealed by a polymeric material that completely fills all interstitial spaces, therefore eliminating any conduits for gas migration. Further, incorporating a polymeric material in the interstitial spaces provides torque balanced two armor wire layer cables, since the outer armor wires are locked in place and protected by a tough polymer jacket, and larger diameters are not required in the outer layer, thus mitigating torque balance problems. Additionally, since the interstitial spaces filled, corrosive downhole fluids cannot infiltrate and accumulate between the armor wires. The polymeric material may also serve as a filter for many corrosive fluids. By minimizing exposure of the armor wires and preventing accumulation of corrosive fluids, the useful life of the cable may be significantly greatly increased.

Also, filling the interstitial spaces between armor wires and separating the inner and outer armor wires with a polymeric material reduces point-to-point contact between the armor wires, thus improving strength, extending fatigue life, and while avoiding premature armor wire corrosion. Because the interstitial spaces are filled the cable core is completely contained and creep is mitigated, and as a result, cable diameters are much more stable and cable stretch is significantly reduced. The creep-resistant polymeric materials used in this invention may minimize core creep in two ways: first, locking the polymeric material and armor wire layers together greatly reduces cable deformation; and secondly, the polymeric material also may eliminate any annular space into which the cable core might otherwise creep. Cables according to the invention may improve problems encountered with caged armor designs, since the polymeric material encapsulating the armor wires may be continuously bonded it cannot be easily stripped away from the armor wires. Because the processes used in this invention allow standard armor wire coverage (93-98% metal) to be maintained, cable strength may not be sacrificed in applying the polymeric material, as compared with typical caged armor designs.

The polymeric materials useful in the cables of the invention include, by nonlimiting example, polyolefins (such as EPC or polypropylene), other polyolefins, polyaryletherether ketone (PEEK), polyaryl ether ketone (PEK), polyphenylene sulfide (PPS), modified polyphenylene sulfide, polymers of ethylene-tetrafluoroethylene (ETFE), polymers of poly(1,4-phenylene), polytetrafluoroethylene (PTFE), perfluoroalkoxy (PFA) polymers, fluorinated ethylene propylene (FEP) polymers, polytetrafluoroethylene-perfluoromethylvinylether (MFA) polymers, Parmax®, and any mixtures thereof. Preferred polymeric materials are ethylene-tetrafluoroethylene polymers, perfluoroalkoxy polymers, fluorinated ethylene propylene polymers, and polytetrafluoroethylene-perfluoromethylvinylether polymers.

The polymeric material used in cables of the invention may be disposed continuously and contiguously from the insulated conductor to the layer of armor wires, or may even extend beyond the outer periphery thus forming a polymeric jacket that completely encases the armor wires. The polymeric material forming the jacket and armor wire coating material may be optionally selected so that the armor wires are not bonded to and can move within the polymeric jacket.

In some embodiments of the invention, the polymeric material may not have sufficient mechanical properties to withstand high pull or compressive forces as the cable is pulled, for example, over sheaves, and as such, may further include short fibers. While any suitable fibers may be used to provide properties sufficient to withstand such forces, examples include, but are not necessarily limited to, carbon fibers, fiberglass, ceramic fibers, Kevlar® fibers, Vectran® fibers, quartz, nanocarbon, or any other suitable material. Further, as the friction for polymeric materials including short fibers may be significantly higher than that of the polymeric material alone, an outer jacket of polymeric material without short fibers may be placed around the outer periphery of the cable so the outer surface of cable has low friction properties.

The polymeric material used to form the polymeric jacket or the outer jacket of cables according to the invention may also include particles which improve cable wear resistance as it is deployed in wellbores. Examples of suitable particles include Ceramer™, boron nitride, PTFE, graphite, nanoparticles (such as nanoclays, nanosilicas, nanocarbons, nanocarbon fibers, or other suitable nano-materials), or any combination of the above.

Cables according to the invention may also have one or more armor wires replaced with coated armor wires. The coating may be comprised of the same material as those polymeric materials described hereinabove. This may help improve torque balance by reducing the strength, weight, or even size of the outer armor wire layer, while also improving the bonding of the polymeric material to the outer armor wire layer.

In some embodiments of the invention, cables may comprise at least one filler rod component in the armor wire layer. In such cables, one or more armor wires are replaced with a filler rod component, which may include bundles of synthetic long fibers or long fiber yarns. The synthetic long fibers or long fiber yarns may be coated with any suitable polymers, including those polymeric materials described hereinabove. The polymers may be extruded over such fibers or yarns to promote bonding with the polymeric jacket materials. This may further provide stripping resistance. Also, as the filler rod components replace outer armor wires, torque balance between the inner and outer armor wire layers may further be enhanced.

Cables according to the invention may be of any practical design, including monocables, coaxial cables, quadcables, heptacables, and the like. In coaxial cable designs of the invention, a plurality of metallic conductors surround the insulated conductor, and are positioned about the same axis as the insulated conductor. Also, for any cables of the invention, the insulated conductors may further be encased in a tape. All materials, including the tape disposed around the insulated conductors, may be selected so that they will bond chemically and/or mechanically with each other. Cables of the invention may have an outer diameter from about 1 mm to about 125 mm, and preferably, a diameter from about 2 mm to about 10 mm.

The materials forming the insulating layers and the polymeric materials used in the cables according to the invention may further include a fluoropolymer additive, or fluoropolymer additives, in the material admixture to form the cable. Such additive(s) may be useful to produce long cable lengths of high quality at high manufacturing speeds. Suitable fluoropolymer additives include, but are not necessarily limited to, polytetrafluoroethylene, perfluoroalkoxy polymer, ethylene tetrafluoroethylene copolymer, fluorinated ethylene propylene, perfluorinated poly(ethylene-propylene), and any mixture thereof. The fluoropolymers may also be copolymers of tetrafluoroethylene and ethylene and optionally a third comonomer, copolymers of tetrafluoroethylene and vinylidene fluoride and optionally a third comonomer, copolymers of chlorotrifluoroethylene and ethylene and optionally a third comonomer, copolymers of hexafluoropropylene and ethylene and optionally third comonomer, and copolymers of hexafluoropropylene and vinylidene fluoride and optionally a third comonomer. The fluoropolymer additive should have a melting peak temperature below the extrusion processing temperature, and preferably in the range from about 200° C. to about 350° C. To prepare the admixture, the fluoropolymer additive is mixed with the insulating jacket or polymeric material. The fluoropolymer additive may be incorporated into the admixture in the amount of about 5% or less by weight based upon total weight of admixture, preferably about 1% by weight based or less based upon total weight of admixture, more preferably about 0.75% or less based upon total weight of admixture.

Referring now to FIG. 1, a cross-sectional generic representation of some cable embodiments according to the invention. The cables include a core 102 which comprises insulated conductors in such configurations as heptacables, monocables, coaxial cables, or even quadcables. A polymeric material 108 is contiguously disposed in the interstitial spaces formed between armor wires 104 and 106, and interstitial spaces formed between the armor wires 104 and core 102. The polymeric material 108 may further include short fibers.

The inner armor wires 104 are evenly spaced when cabled around the core 102. The armor wires 104 and 106 may be coated armor wires as described herein above. The polymeric material 108 may extend beyond the outer armor wires 106 to form a polymeric jacket thus forming a polymeric encased cable 100.

In one method of preparing the cable 100, according to the invention, a first layer of polymeric material 108 is extruded upon the core insulated conductor(s) 102, and a layer of inner armor wires 104 are served thereupon. The polymeric material 108 is then softened, by heating for example, to allow the inner armor wires 104 to embed partially into the polymeric material 108, thereby eliminating interstitial gaps between the polymeric material 108 and the armor wires 104. A second layer of polymeric material 108 is then extruded over the inner armor wires 104 and may be bonded with the first layer of polymeric material 108. A layer of outer armor wires 106 are then served over the second layer of polymeric material 108. The softening process is repeated to allow the outer armor wires 106 to embed partially into the second layer of polymeric material 108, and removing any interstitial spaces between the inner armor wires 104 and outer armor wires 106. A third layer of polymeric material 108 is then extruded over the outer armor wires 106 embedded in the second layer of polymeric material 108, and may be bonded with the second layer of polymeric material 108.

Figure 2:
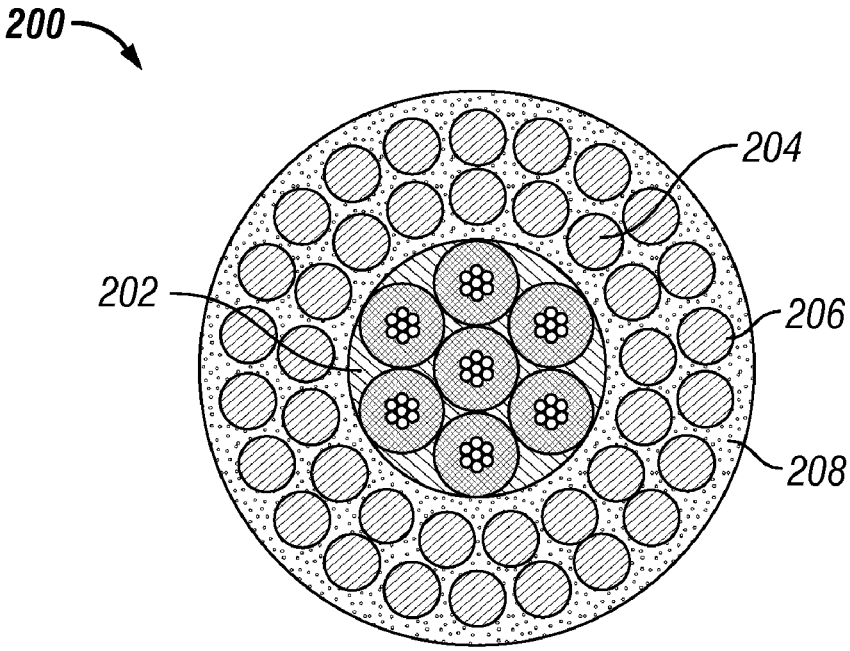
FIG. 2 is a stylized cross-sectional representation of a heptacable according to the invention.
Figure 3:
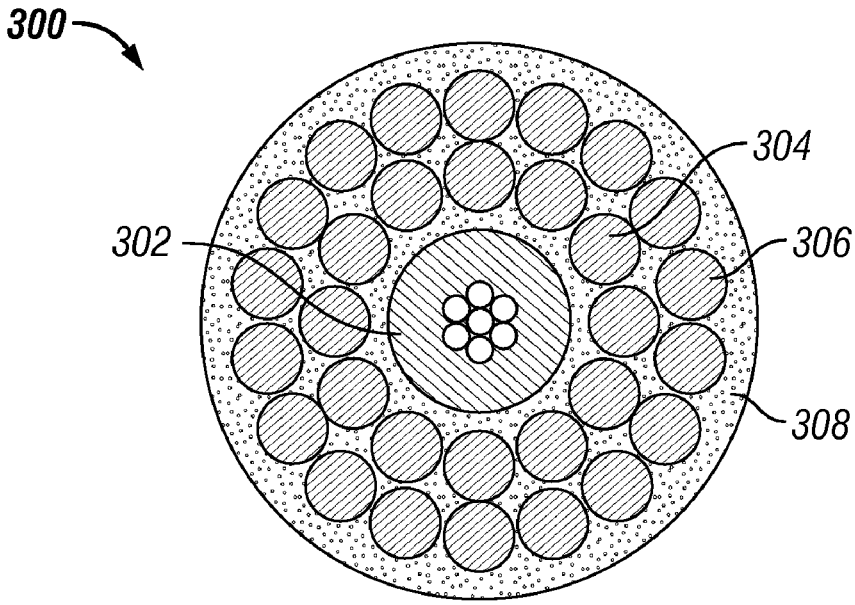
FIG. 3 is a stylized cross-sectional representation of a monocable according to the invention.

FIG. 2, illustrates a cross-sectional representation of a heptacable according to the invention. Similar to cable 100 illustrated in FIG. 1, the heptacable includes a core 202 comprised of seven insulated conductors in a heptacable configuration. A polymeric material 208 is contiguously disposed in the interstitial spaces formed between armor wires 204 and 206, and interstitial spaces formed between the armor wires 204 and heptacable core 202. The armor wires 204 and 206 may be coated armor wires as well. The polymeric material 208 may extend beyond the outer armor wires 206 to form a sealing polymeric jacket. Another cable embodiment of the invention is shown in FIG. 3, which is a cross-sectional representation of a monocable. The cable includes a monocable core 302, a single insulated conductor, which is surrounded with a polymeric material 308. The single insulated conductor is comprised of seven metallic conductors encased in an insulated jacket. The polymeric material is disposed about in the interstitial spaces formed between inner armor wires 304 and outer armor wires 306, and interstitial spaces formed between the inner armor wires 304 and insulated conductor 302. The polymeric material 308 may extend beyond the outer armor wires 306 to form a sealing polymeric jacket.

Figure 4:
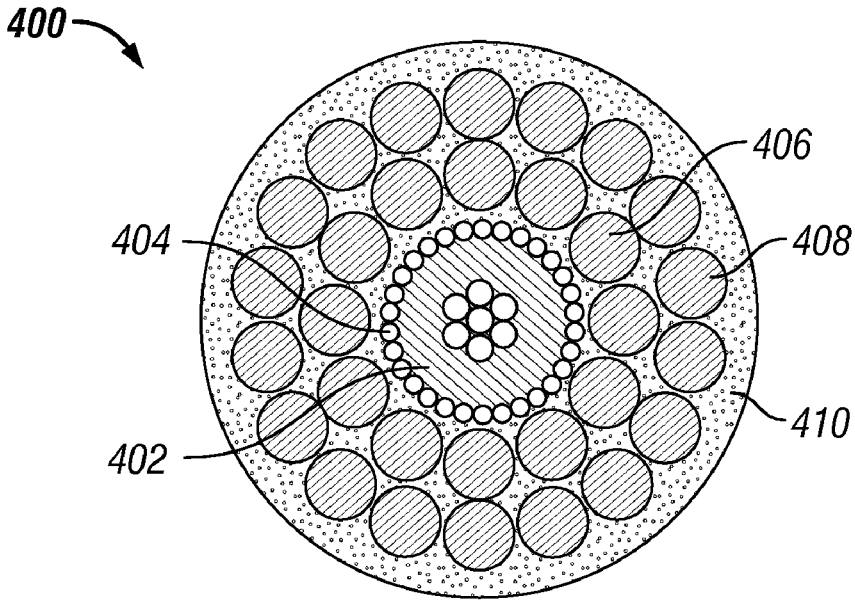
FIG. 4 is a stylized cross-sectional representation of a coaxial cable according to the invention.

FIG. 4 illustrates yet another embodiment of the invention, which is a coaxial cable. Cables according to this embodiment include an insulated conductor 402 at the core similar to the monocable insulated conductor 302 shown in FIG. 3. A plurality of metallic conductors 404 surround the insulated conductor, and are positioned about the same axis as the insulated conductor 402. A polymeric material 410 is contiguously disposed in the interstitial spaces formed between armor wires 406 and 408, and interstitial spaces formed between the armor wires 406 and plurality of metallic conductors 404. The inner armor wires 406 are evenly spaced. The armor wires 406 and 408 may be coated armor wires. The polymeric material 410 may extend beyond the outer armor wires 408 to form a polymeric jacket thus encasing and sealing the cable 400.

Figure 5:
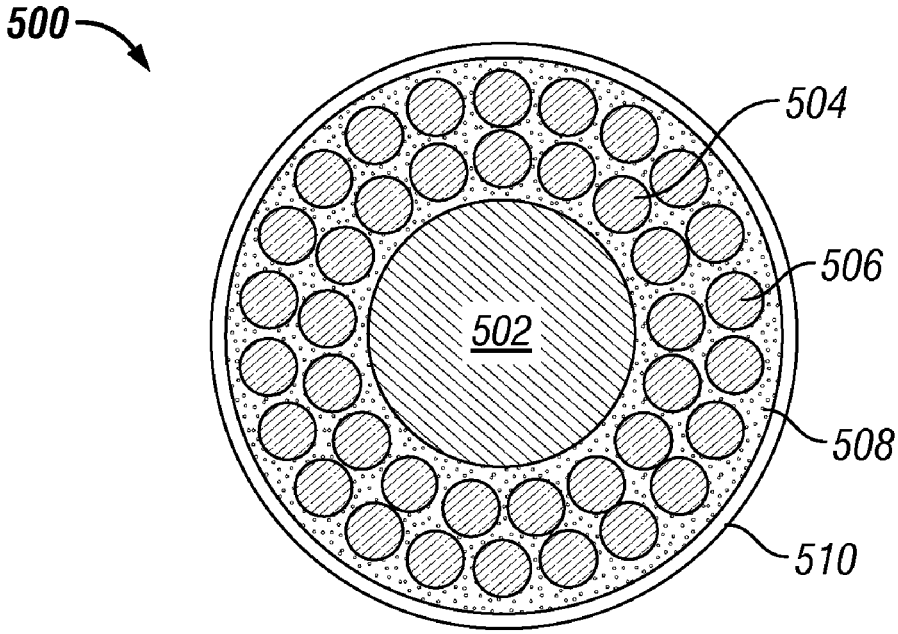
FIG. 5 is a cross-section illustration of a cable according to the invention which comprises a outer jacket formed from a polymeric material and where the outer jacket surrounds a polymeric material layer that includes short fibers.

In cable embodiments of the invention where the polymeric material extends beyond the outer periphery to form a polymeric jacket completely encasing the armor wires, the polymeric jacket is formed from a polymeric material as described above, and may further comprise short fibers and/or particles. Referring now to FIG. 5, a cable according to the invention which comprises an outer jacket, the cable 500 is comprised of a at least one insulated conductor 502 placed in the core position, a polymeric material 508 contiguously disposed in the interstitial spaces formed between armor wire layers 504 and 506, and interstitial spaces formed between the armor wires 504 and insulated conductor(s) 502. The polymeric material 508 extends beyond the outer armor wires 506 to form a polymeric jacket. The cable 500 further includes an outer jacket 510, which is bonded with polymeric material 508, and encases polymeric material 508, armor wires 504 and 506, as well as insulated conductor(s) 502. The outer jacket 510 is formed from a polymeric material, free of any fiber, but may contain particles as described hereinabove, so the outer surface of cable has low friction properties. Further, the polymeric material 508 may contain a short fiber to impart strength in the cable.

Figure 6:
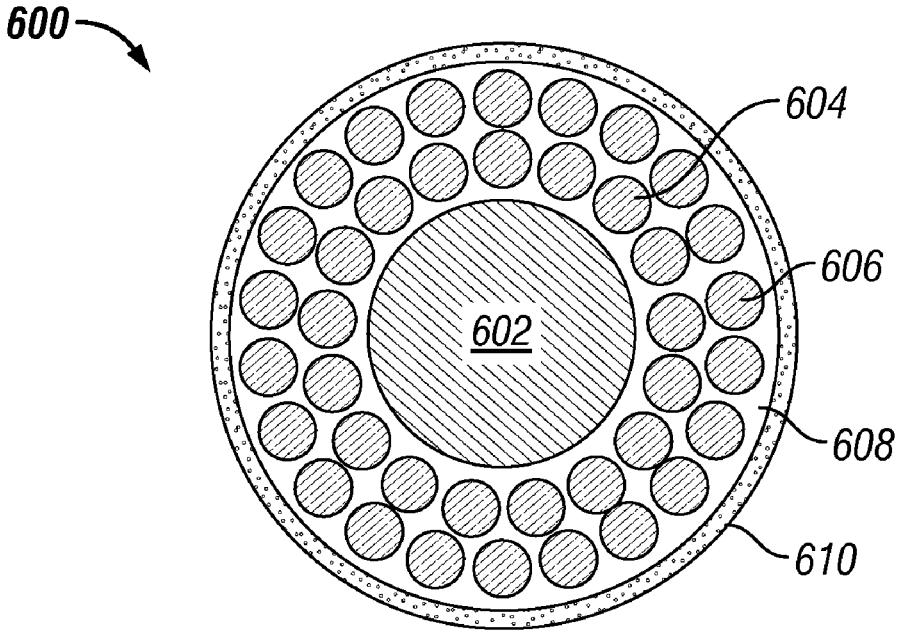
FIG. 6 is a cross-sectional representation of a cable of the invention, which has an outer jacket formed from a polymeric material including short fibers, and where the outer jacket surrounds a polymeric material layer.

FIG. 6 illustrates yet another embodiment of a cable of the invention, which has a polymeric jacket including short fibers. Cable 600 includes at least one insulated conductor 602 in the core, a polymeric material 608 contiguously disposed in the interstitial spaces formed between armor wire layers 604 and 606, and interstitial spaces formed between the armor wires 604 and insulated conductor(s) 602. The polymeric material 608 may extend beyond the outer armor wires 606 to form a polymeric jacket. The cable 600 includes an outer jacket 610, bonded with polymeric material 608, and encasing the cable. The outer jacket 610 is formed from a polymeric material that also includes short fibers. The polymeric material 608 may optionally be free of any short fibers or particles.

Figure 7:
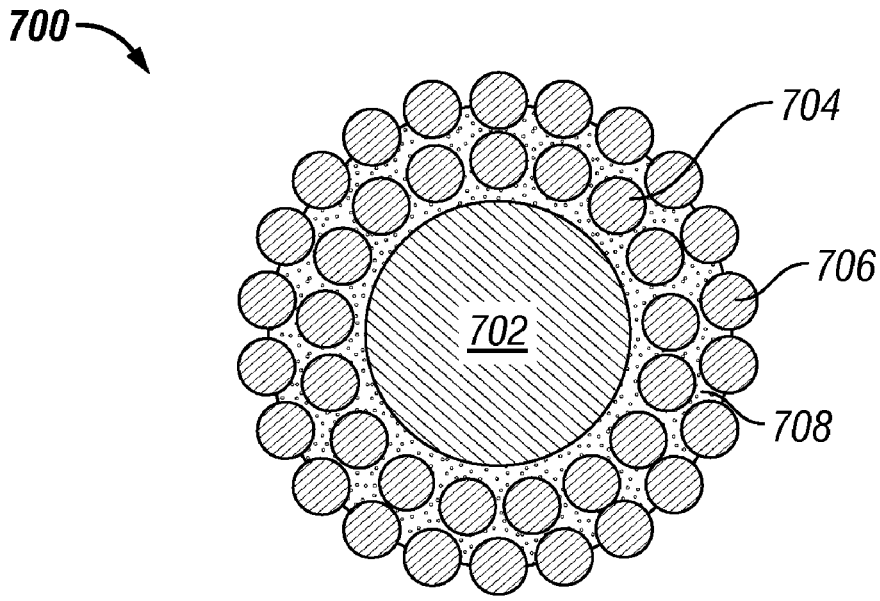
FIG. 7 is a cross-section illustration of a cable according to the invention which includes a polymeric material partially disposed about the outer armor wires.

In some cables according to the invention, the polymeric material may not necessarily extend beyond the outer armor wires. Referring to FIG. 7, which illustrates a cable with polymeric material partially disposed about the outer armor wires, the cable 700 has at least one insulated conductor 702 at the core position, a polymeric material 708 disposed in the interstitial spaces formed between armor wires 704 and 706, and interstitial spaces formed between the inner armor wires 704 and insulated conductor(s) 702. The polymeric material is not extended to substantially encase the outer armor wires 706. In some other embodiments, the outer layer of armor wires formed from wires 708 may be an outer armoring layer formed of strength members, such as those as described below in FIG. 11.

Figure 8:
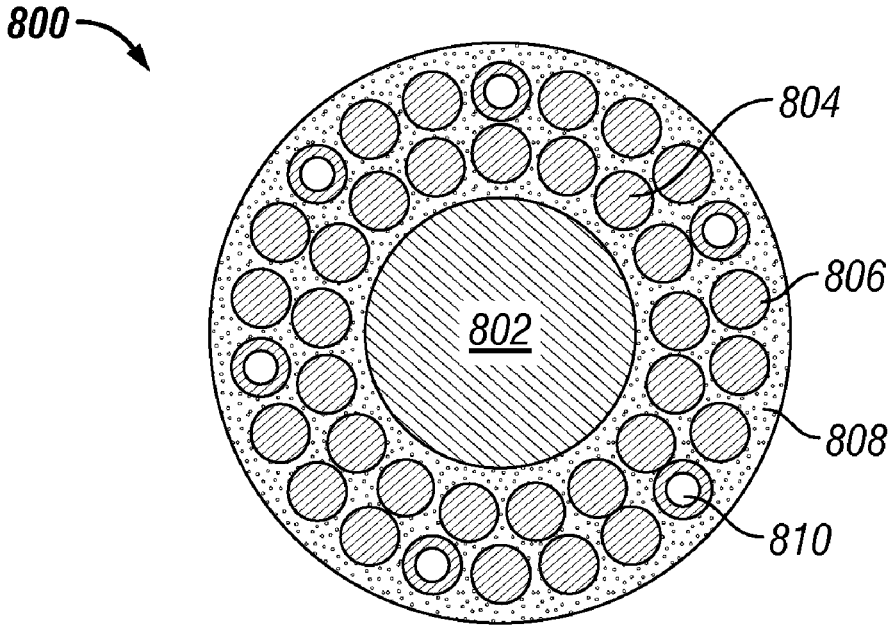
FIG. 8 is a cross section which illustrates a cable which includes coated armor wires in the outer armor wire layer.

Coated armor wires may be placed in either the outer and inner armor wire layers, or both. Including coated armor wires, wherein the coating is a polymeric material as mentioned hereinabove, may improve bonding between the layers of polymeric material and armor wires. The cable represented in FIG. 8 illustrates a cable which includes coated armor wires in the outer armor wire layer. Cable 800 has at least one insulated conductor 802 at the core position, a polymeric material 808 disposed in the interstitial spaces and armor wires 804 and 806, and interstitial spaces formed between the inner armor wires 804 and insulated conductor(s) 802. The polymeric material is extended to substantially encase the outer armor wires 806. The cable further comprises coated armor wires 810 in the outer layer of armor wires.

Figure 9:
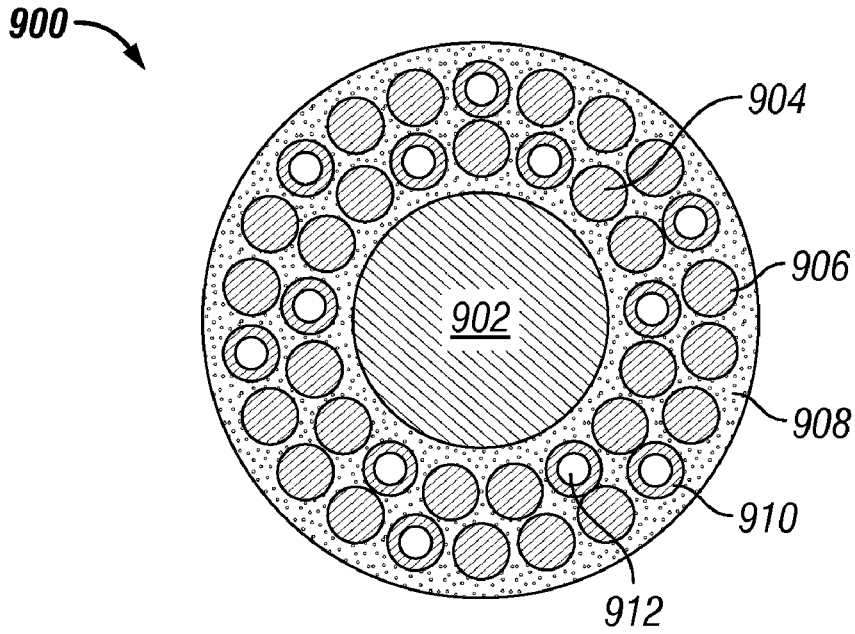
FIG. 9 is a cross section which illustrates a cable which includes a coated armor wires in the inner and outer armor wire layers.

Referring to FIG. 9, a cable that includes coated armor wires in both inner and outer armor wire layers, 910 and 912. Cable 900 is similar to cable 800 illustrated in FIG. 8, comprising at least one insulated conductor 902 at the core position, a polymeric material 908 disposed in the interstitial spaces, armor wires 904 and 906, and the polymeric material is extended to substantially encase the outer armor wires 906 to form a polymeric jacket thus encasing and sealing the cable 900.

Figure 10:
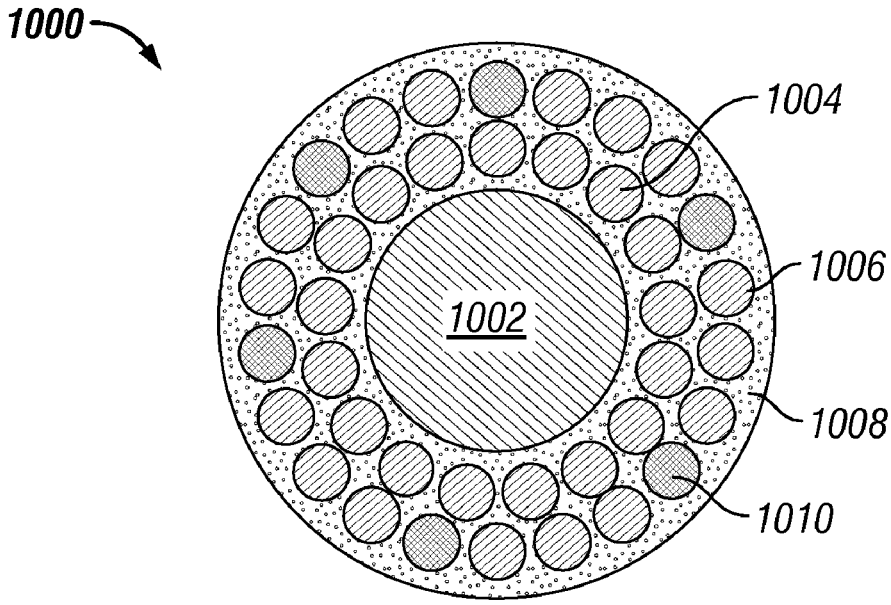
FIG. 10 is a cross section illustrating a cable which includes filler rod components in the outer armor wire layer.

Referring to FIG. 10, a cable according to the invention which includes filler rod components in the armor wire layer. Cable 1000 includes at least one insulated conductor 1002 at the core position, a polymeric material 1008 disposed in the interstitial spaces and armor wires 1004 and 1006. The polymeric material 1008 is extended to substantially encase the outer armor wires 1006, and the cable further includes filler rod components 1010 in the outer layer of armor wires. The filler rod components 1010 include a polymeric material coating which may further enhance the bond between the filler rod components 1010 and polymeric material 1008.

Figure 11:
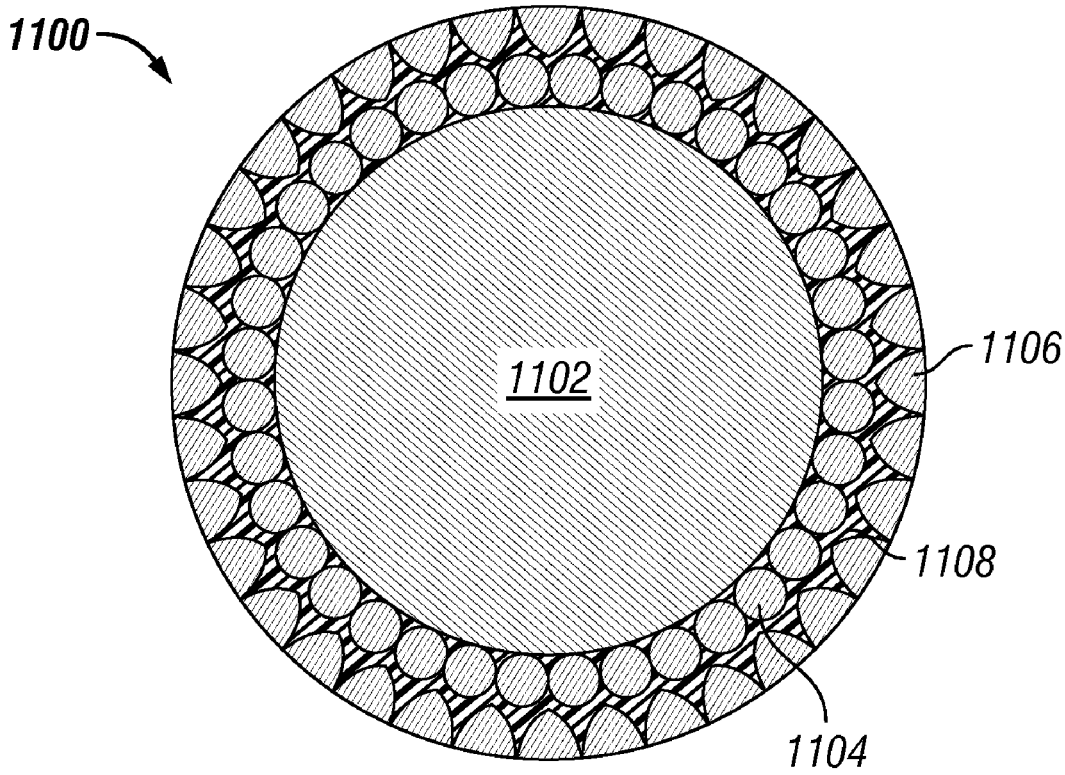
FIG. 11 is a cross-sectional generic representation of some cable embodiments according to the invention which have an outer armor layer formed from shaped strength members.

Referring now to FIG. 11, a cross-sectional generic representation of some cable embodiments according to the invention which have an outer armor layer formed from shaped strength members. The cables include a core 1102 which comprises insulated conductors in such configurations as heptacables, monocables, coaxial cables, or even quadcables. A polymeric material 1108 is continuously disposed in the interstitial spaces formed between armor wires 1104 and shaped strength members 1106, and interstitial spaces formed between the armor wires 1104 and core 1102. The armor wires 1104 and shaped strength members 1106 are evenly spaced when cabled around the core 1102. The polymeric material 1108 may extend beyond the layer of inner armor wires 1104 and into the interstitial spaces between shaped strength members 1106.

In one method of preparing the cable 1100, according to the invention, a first layer of polymeric material 1108 is extruded upon the core insulated conductor(s) 1102, and a layer of inner armor wires 1104 are served thereupon. The polymeric material 1108 is then softened, by heating for example, to allow the inner armor wires 1104 to embed partially into the polymeric material 1108, thereby eliminating interstitial gaps between the polymeric material 1108 and the armor wires 1104. A second layer of polymeric material 1108 is then extruded over the inner armor wires 1104 and may be bonded with the first layer of polymeric material 1108. A layer of shaped strength members 1106 are then served over the second layer of polymeric material 1108. The softening process is repeated to allow the shaped strength members 1106 to embed partially into the second layer of polymeric material 1108, and removing any interstitial spaces between the inner armor wires 1104 and shaped strength members 1106.

Figure 12:
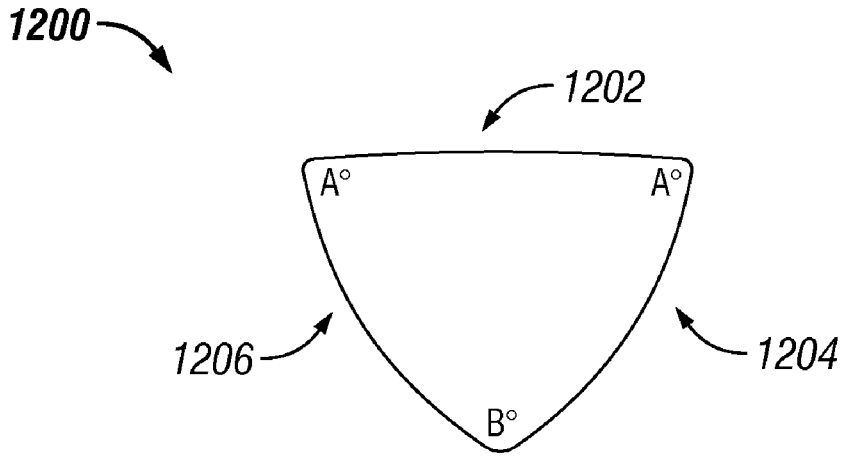
FIG. 12 and FIG. 13 illustrate by cross-sectional representation, some profile shapes and construction for strength members useful in the invention.
Figure 13:
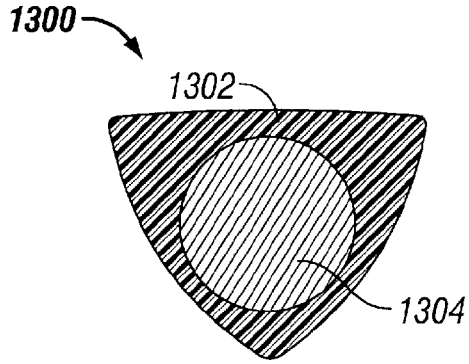

Referring again to FIG. 11, while any suitable shaped strength member may be used in some cables of the invention, the shaped strength members 1106 shown therein are a "shield"-shaped profile. The shape is roughly that of an isosceles triangle. Referring now to FIG. 12, the "base" (top of shield) 1202 is shaped with a radius such that when configured to form an outer layer, the outside circumference of the completed wireline cable 1100 is essentially matched thus forming an substantially smooth outer cable surface. The other two sides, 1204 and 1206, are approximately to one another in arc and in length. As in an isosceles triangle the sides, 1204 and 1206, are at the same angle A° to the base 1202. The shield shaped strength member 1200 may be created by drawing a round armor wire into the shape, or (as shown in FIG. 13) by extruding a polymeric shell 1302 over a round wire 1304. The polymeric shell 1302 may be amended with short synthetic fibers for additional strength and compression and cut-through resistance.

Figure 14:
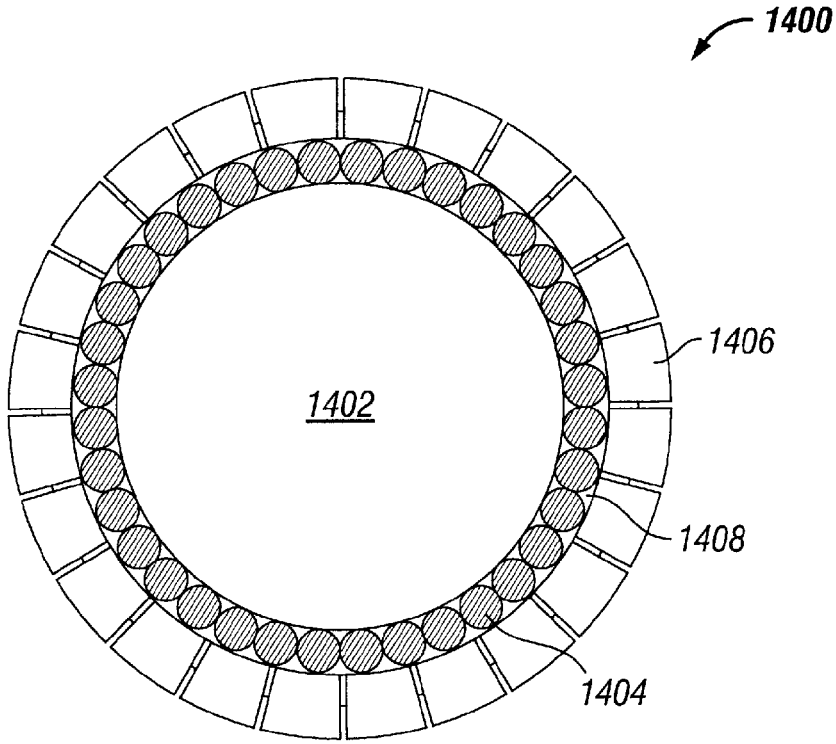
FIG. 14 and FIG. 15 show some cable embodiments of the invention which include keystone shaped outer strength members.
Figure 14A:
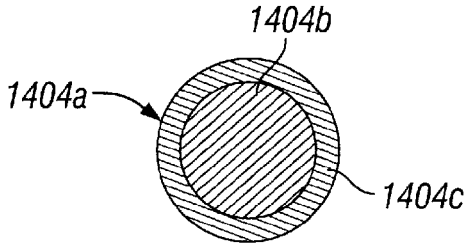
FIGS. 14A and 14B show embodiments of a bimetallic armor wire and a bimetallic shaped strength member of a cable of the invention.
Figure 14B:
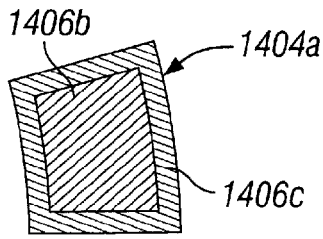
Figure 15:
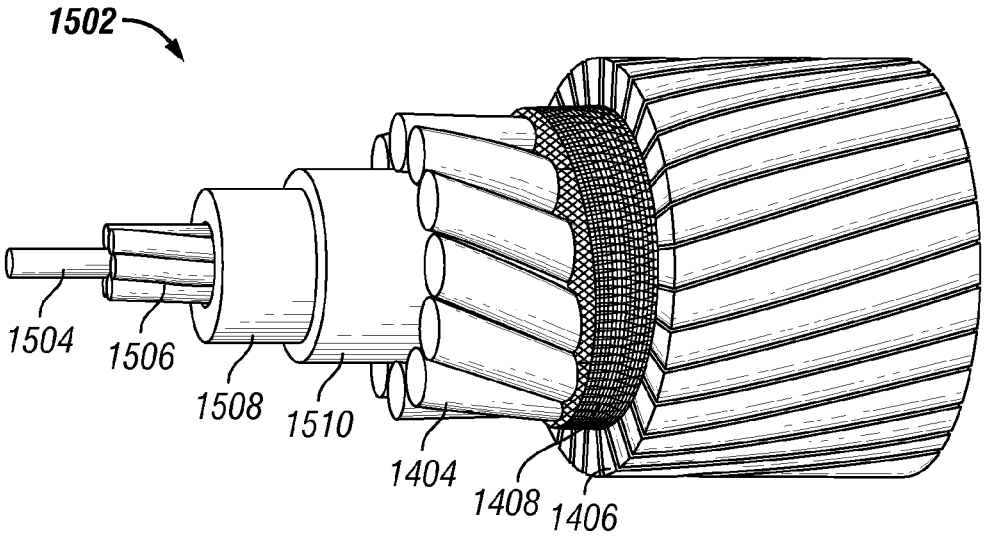

Referring now to FIGS. 14 and 15 which show some cable embodiments of the invention which include keystone shaped outer strength members, the core 1402 can include insulated conductors in such configurations as heptacables, monocables, coaxial cables, or even quadcables. In the embodiment shown in FIG. 15, the core 1502 is a stacked dielectric monocable core which includes central metallic conductor 1504 surrounded by six conductors 1506 (only one indicated) helically disposed upon central conductor 1504, and first and second insulating layers 1508 and 1510. A polymeric material 1408 is continuously disposed in the interstitial spaces formed between armor wires 1404 (only one indicated) and shaped strength members 1406 (only one indicated), and interstitial spaces formed between the armor wires 1404 and core 1402 or 1502. The polymeric material 1408 may extend beyond the layer of inner armor wires 1404 and into the interstitial spaces between shaped strength members 1406. The shaped strength members 1406 are shaped such that the position is secured (maintained) within the layer of strength members.

Figure 16:
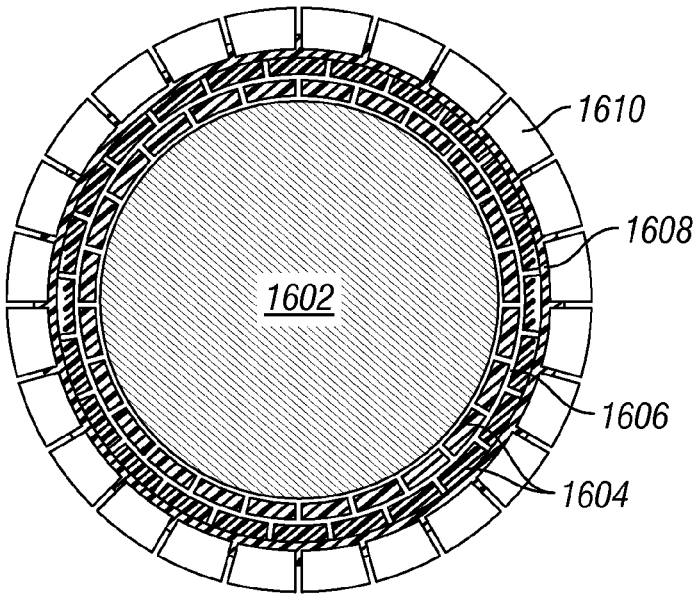
FIG. 16 illustrates cables according to the invention which incorporate composite strength members which form at least one inner strength member layer.

FIG. 16 illustrates cables according to the invention which incorporate composite strength members which form at least one inner strength member layer. In FIG. 16, layers of served polymer/long fiber composite strength members (tows) 1604 (only two indicated) are used as inner strength members around core 1602. The strips are contained within an interstitial filler 1606. A polymeric material, such as a jacket, 1608 may be applied over the out periphery of the layer(s) of composite strength members 1604. Shaped strength members 1610 (only one indicated), such as keystone shaped members, are applied over and partially embedded into the polymeric material 1608. The shaped strength members 1610 may lock together in the polymeric material. The keystone shape may creates a compression-resistant continuous arch. The shaped strength members 1610 provide a smooth outer sealing surface for the completed cable.

Figure 17:
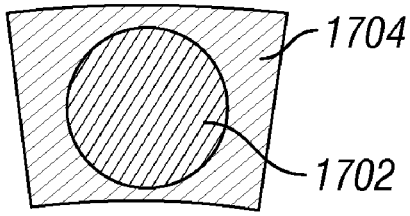
FIG. 17 shows a side profile of a keystone-shaped strength member.

Keystone-shaped strength members can be formed by any suitable means, such as from a steel wire, or even by extruding a polymer/fiber composite 1702 over a round steel wire 1704 as illustrated in FIG. 17.

Figure 18:
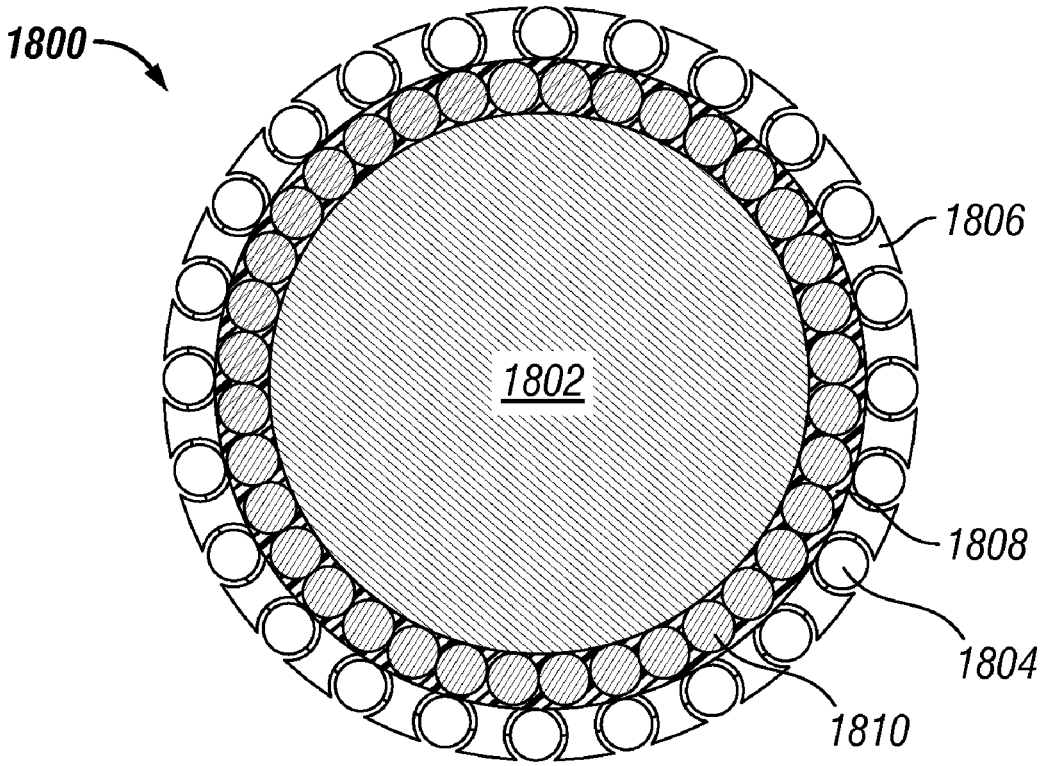
FIG. 18 represents a cable embodiment using a plurality of different shaped strength member to form the outer layer.

FIG. 18 illustrates by cross-sectional view, a cable using a plurality of different shaped strength member to form the outer layer. In this design, circular shaped strength members 1804 (only one indicated) are alternated with bi-concave-shaped strength members 1806 (only one indicated) that mate with the round strength members 1804. Shaped strength members 1804 and 1806 imbed and are locked into the polymer material 1808, which surrounds armor wires 1810 (only one indicated) and core 1802. The outer surfaces of the strength members 1804 and 1806 combine to form a substantially smooth outer cable surface, and the overall shape of the strength members 1802 secures their position within the layer of strength members.

Figure 19:
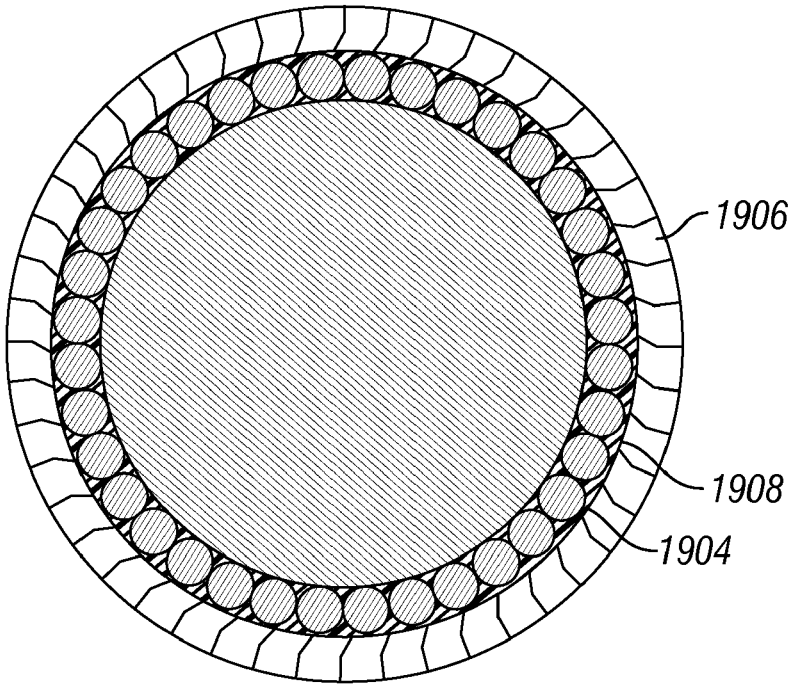
FIG. 19 is a graphical illustration of some cable embodiments according to the invention which have an outer armor layer formed from shaped strength members, where the bottom profile of each outer strength member slants to help secure the position of strength members within the layer of strength members.

Referring now to FIG. 19, a representation of some cable embodiments according to the invention which have an outer armor layer formed from shaped strength members, where the bottom profile of each outer strength member slants to help secure the position of strength members within the layer of strength members. The cables include a core 1902, a polymeric material 1908 continuously disposed in the interstitial spaces formed between armor wires 1904 and shaped strength members 1906, and interstitial spaces formed between the armor wires 1904 and core 1902. The armor wires 1904 and shaped strength members 1906 are evenly spaced when cabled around the core 1102. The outer surfaces of the strength members 1906 combine to create a substantially smooth circumference for the completed cable. The polymeric material 1908 may extend beyond the layer of inner armor wires 1904 and into the interstitial spaces between shaped strength members 1906.

Figure 20:
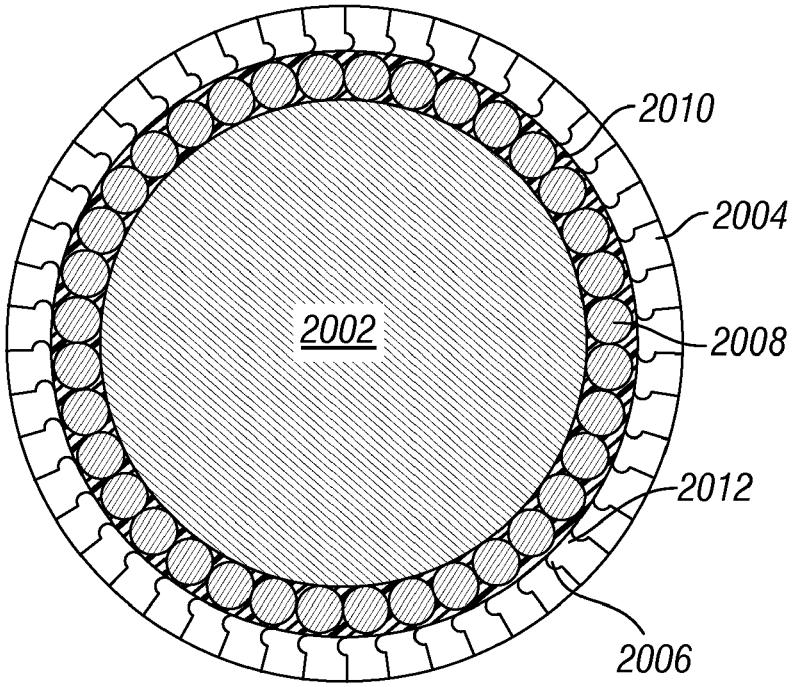
FIG. 20 is a cross sectional view of a cable according to the invention where the profile of each outer shaped strength is of a convex "tongue" shape on one side and a concave "groove" on the opposing side.

In FIG. 20, a cross sectional view of a cable according to the invention is provided where the profile of each outer shaped strength member 2004 (only one indicated) is of a convex "tongue" shape on one side 2006 and a concave "groove" on the opposing side 2008. These shapes mate to each other and secure the strength members' 2004 position within the layer of strength members. The strength members 2004 may also imbed and locked the polymeric material 2010 encasing the inner strength members 2012 and core 2002. Outer surfaces of the strength members combine to create a substantially smooth circumference for the completed wireline cable. Here too, the polymeric material 2010 may extend beyond the layer of inner armor wires 2012 and into the interstitial spaces between shaped strength members 2004.

Cables of the invention may include armor wires employed as electrical current return wires which provide paths to ground for downhole equipment or tools. The invention enables the use of armor wires for current return while minimizing electric shock hazard. In some embodiments, the polymeric material isolates at least one armor wire in the first layer of armor wires thus enabling their use as electric current return wires.

The present invention is not limited, however, to cables having only metallic conductors. Optical fibers may be used in order to transmit optical data signals to and from the device or devices attached thereto, which may result in higher transmission speeds, lower data loss, and higher bandwidth.

Cables according to the invention may be used with wellbore devices to perform operations in wellbores penetrating geologic formations that may contain gas and oil reservoirs. The cables may be used to interconnect well logging tools, such as gamma-ray emitters/receivers, caliper devices, resistivity-measuring devices, seismic devices, neutron emitters/receivers, and the like, to one or more power supplies and data logging equipment outside the well. Cables of the invention may also be used in seismic operations, including subsea and subterranean seismic operations. The cables may also be useful as permanent monitoring cables for wellbores.

For wellbores with a potential well head pressure, flow tubes with grease pumped under pressure into the constricted region between the cable and a metallic pipe are typically used for wellhead pressure control. The number of flow tubes depends on the absolute wellhead pressure and the permissible pressure drop across the flow tube length. The grease pump pressure of the grease is typically 20% greater than the pressure at the wellhead. Cables of the invention may enable use of pack off devices, such as by non-limiting example rubber pack-offs, as a friction seal to contain wellhead pressure, thus minimizing or eliminating the need for grease packed flow tubes. As a result, the cable rig up height on for pressure operations is decreased as well as down sizing of related well site surface equipment such as a crane/boom size and length. Also, the cables of the invention with a pack off device will reduce the requirements and complexity of grease pumps as well as the transportation and personnel requirements for operation at the well site. Further, as the use of grease imposes environmental concerns and must be disposed off based on local government regulations, involving additional storage/transportation and disposal, the use of cables of the invention may also result in significant reduction in the use of grease or its complete elimination.

Cables of the invention which have been spliced may be used at a well site. Since the traditional requirement to utilize metallic flow tubes containing grease with a tight tolerance as part of the wellhead equipment for pressure control may be circumvented with the use of friction seal pack off equipment, such tight tolerances may be relaxed. Thus, use of spliced cables at the well site may be possible.

As some cables of the invention are smooth, or slick, on the outer surface, frictional forces (both with WHE and cable drag) are significantly reduced as compared with similar sized armored logging cables. The reduced friction would make possible the ability to use less weight to run the cable in the wellbore and reduction in the possibility of vortex formation, resulting in shorter tool strings and additional reduction in the rig up height requirements. The reduced cable friction, or also known as cable drag, will also enhance conveyance efficiency in corkscrew completions, highly deviated, S-shaped, and horizontal wellbores.

As traditional armored cables tend to saw to cut into the wellbore walls due to their high friction properties, and increase the chances of differential pressure sticking ("key seating" or "differential sticking"), the cables of the invention reduces the chances of differential pressure sticking since the slick outer surface may not easily cut into the wellbore walls, especially in highly deviated wells and S-shaped well profiles. The slick profile of the cables would reduce the frictional loading of the cable onto the wellbore hardware and hence potentially reduce wear on the tubulars and other well bore completion hardware (gas lift mandrels, seal bore's, nipples, etc.).

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values. Accordingly, the protection sought herein is as set forth in the claims below.

The invention claimed is:

1. A wellbore cable comprising:

(a) at least one insulated conductor;

(b) at least one layer of composite strength members surrounding the insulated conductor, interstitial spaces formed between the composite strength members filled with a polymeric material;

(c) said polymeric material disposed in said interstitial spaces formed between the composite strength members and interstitial spaces formed between the composite strength members and the insulated conductor, the polymeric material forming a continuously bonded layer which separates and encapsulates the composite strength members forming the at least one layer of composite strength members; and (d) a layer of shaped strength members disposed adjacent the outer periphery of the at least one first layer of composite strength members, the shaped strength members forming a substantially smooth outer surface of the cable.

2. A cable according to claim 1 wherein the polymeric material is at least partially disposed in interstitial spaces formed between shaped strength members.

3. A cable according to claim 1 wherein the shaped strength members have a cross-sectional geometric shape which serves to secure the position of the shaped strength members within the layer of strength members.

4. A cable according to claim 1 wherein the insulated conductor comprises a plurality of metallic conductors encased in an insulated jacket.

5. A cable according to claim 4 wherein the insulated conductor comprises:

(a) a first insulating jacket layer disposed around the metallic conductors wherein the first insulating jacket layer has a first relative permittivity; and (b) a second insulating jacket layer disposed around the first insulating jacket layer and having a second relative permittivity that is less than the first relative permittivity.

6. A cable according to claim 5, wherein the first relative permittivity is within a range of about 2.5 to about 10.0, and wherein the second relative permittivity is within a range of about 1.8 to about 5.0.

7. A cable according to claim 1 further comprising a plurality of metallic conductors surrounding the insulated conductor.

8. A cable according to claim 1 wherein the polymeric material is selected from the group consisting of polyolefins, polyaryletherether ketone, polyaryl ether ketone, polyphenylene sulfide, modified polyphenylene sulfide, polymers of ethylene-tetrafluoroethylene, polymers of poly(1,4-phenylene), polytetrafluoroethylene, perfluoroalkoxy polymers, fluorinated ethylene propylene, polytetrafluoroethylene-perfluoromethylvinylether polymers, and any mixtures thereof.

9. A cable according to claim 1 wherein the polymeric material is an ethylene-tetrafluoroethylene polymer.

10. A cable according to claim 1 which has an outer diameter from about 1 mm to about 125 mm.

11. A cable according to claim 10 wherein the outer diameter is from about 2 mm to about 10 mm.

12. A cable according to claim 1 wherein the insulated conductor comprises a monocable.

13. A cable according to claim 1 wherein the insulated conductor comprises a quadcable.

14. A cable according to claim 1 wherein the insulated conductor comprises a heptacable.

15. A cable according to claim 1 wherein the insulated conductor comprises a coaxial cable.

16. A cable according to claim 1 wherein at least one shaped strength member is a bimetallic shaped strength member.

17. A cable according to claim 1 wherein the shaped strength members have a cross-sectional geometric shape which is trapezoidal, rhombic, triangular, square, keystone, circular, oval, concave, convex, rectangular, or any combination thereof.

* * * * *